United States Patent [19]

Ono et al.

[11] 4,308,057

[45] Dec. 29, 1981

[54] STEEL MAKING BY CONVERTER

[75] Inventors: Shigeyuki Ono; Akichika Ozeki; Eiichi Sakamoto; Kiyomi Taguchi; Yoshio Miyashita, all of Fukuyama, Japan

[73] Assignee: Nippon Kokan Kabushiki Kaisha, Tokyo, Japan

[21] Appl. No.: 174,814

[22] Filed: Aug. 4, 1980

[30] Foreign Application Priority Data

Aug. 2, 1979 [JP] Japan ..... 54-98119

[51] Int. Cl.[3] ..... C21C 5/34

[52] U.S. Cl. ..... 75/60; 75/59

[58] Field of Search ..... 75/59, 60

[56] References Cited

U.S. PATENT DOCUMENTS

| | | | |
|---|---|---|---|
| 3,854,932 | 12/1974 | Bishop | 75/60 |
| 3,953,199 | 4/1976 | Michaelis | 75/60 |
| 4,089,677 | 5/1978 | Spenceley | 75/60 |
| 4,178,173 | 12/1979 | Gorges | 75/52 |

*Primary Examiner*—P. D. Rosenberg

[57] ABSTRACT

Steel making by a converter comprises blowing oxygen onto the surface of molten steel held in the converter and blowing agitating gases of 1/3 to 1/3000 of the amount of said oxygen thereinto from tuyeres provided at bottom of the converter, which number from 1 to 30 and are from 2 to 30 mmϕ in inside diameter, thereby to effectively agitate the molten steel and make blowing reaction stabilized for purposes of increasing production and improving quality of the steel.

10 Claims, 5 Drawing Figures

STEEL MAKING BY CONVERTER

BRIEF DESCRIPTION OF THE INVENTION

The invention relates to steel making by converter. In the prior art with respect to a converter of top-blowing of pure oxygen, a steel bath is agitated by $O_2$-jet blown above the molten surface and bubbles of CO generated in the bath, and reaction is progressed. However, in a case of the large scaled converter, the $O_2$-jet cannot reach to a deep part of the bath and the molten steel thereabout is stagnated so that the reaction is delayed and non-uniform dispersion is created.

As countermeasures improving these disadvantages, there is Q-BOP Process, in which oxygen is blown from the bottom of the converter and at the same time the natural gas (hydrocarbon) should be much blown for cooling oxygen. Therefore, hydrogen in steel inevitably increases and the molten steel be subjected to degassing treatment in a post process. Further, it is necessary to much blow $N_2$ gas or the like such that the tuyere is not clogged during sampling or pouring the steel, but $N_2$ spoils the quality of the steel. In addition, while supplying $N_2$, fine dust is considerably blown disadvantageously.

The present invention has been realized in view of these circumstances, in which the steel making comprises blowing oxygen onto the surface of the molten steel held in the converter and blowing agitating gases of $\frac{1}{3}$ to 1/3000 of the amount of of the oxygen thereinto from tuyeres provided at bottom of the converter, which number from 1 to 30 and are from 2 to 30 mmϕ in inside diameter, thereby to effectively agitate the molten steel and make blowing reaction stabilized for purposes of increasing production and improving quality of the steel.

According to the invention, the pure oxygen is blown via a lance onto the surface of the molten steel and at the same time the agitating gas is blown from the tuyeres provided at the bottom of the converter. The agitating gases may be various, and desirous are such inert gases as $CO_2$, CO, Ar, $N_2$ or LD gas. If $CO_2$ gas is used, the reaction of "$CO_2 \rightarrow C+O$", whereby the tuyere is protectively cooled, and since the volume is doubled, the agitating effect is increased and this effect serves to decrease the fundamental unit of $O_2$ as an oxidizing agent. If LD gas is used, it may be circulated in use with economical merit. The tuyere is from 2 to 30 mmϕ in inside diameter. From 1 to 30 tuyeres are used to blow the agitating gas in the amount from $\frac{1}{3}$ to 1/3000 of the amount of the top-blowing oxygen.

The above mentioned outlines the present invention. A reference will be made to embodiment according to the invention.

DETAILED DESCRIPTION OF THE INVENTION

Figure 1:
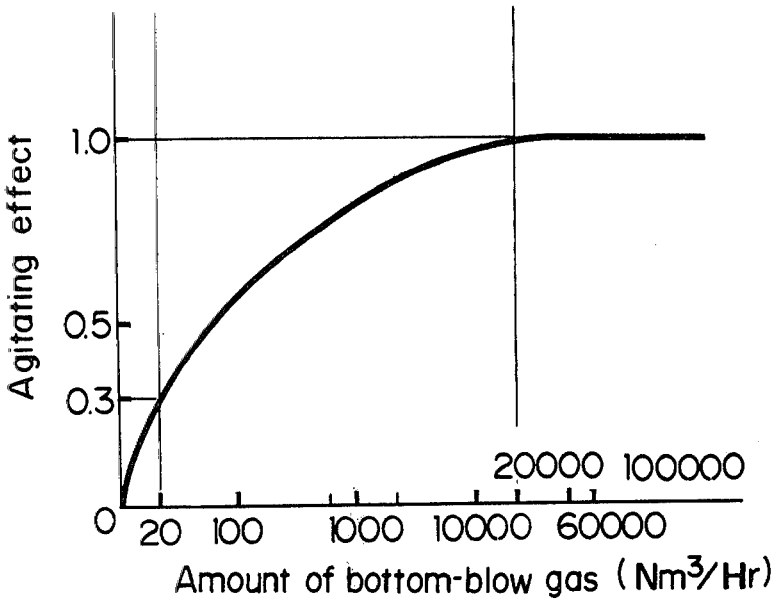
FIG. 1 is a graph showing relation between the amount of the bottom-blowing gas and the agitating effect.

In reference to the attached drawings, FIG. 1 is a graph showing the relation between the amount of the bottom-blowing gas and the agitating effect when the amount of the top-blowing oxygen is 60000 $Nm^3/h$. It is apparent from this graph that the bottom-blowing of more than 20 $Nm^3/h$ is required for providing the agitating effect of more than 0.3. In this point, the agitating effect is almost saturated with 20000 $Nm^3/h$. Therefore, the upper limit of the amount of the bottom-blowing gas is determined as 20,000 $Nm^3/h$/60,000 $Nm^3/h=\frac{1}{3}$, and the lower limit is determined as 20 $Nm^3/h$/60,000 $Nm^3/h=1/3000$.

Figure 2:
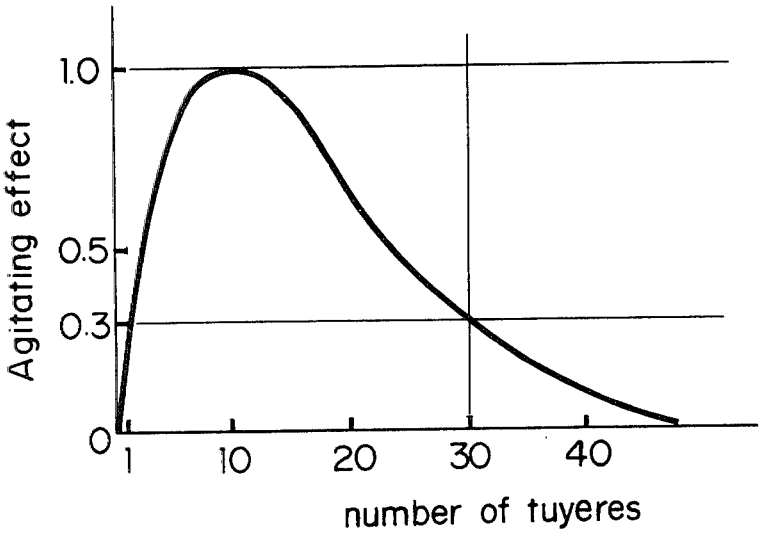
FIG. 2 is a graph showing relation between the number of the tuyeres and the agitating effect.
Figure 3:
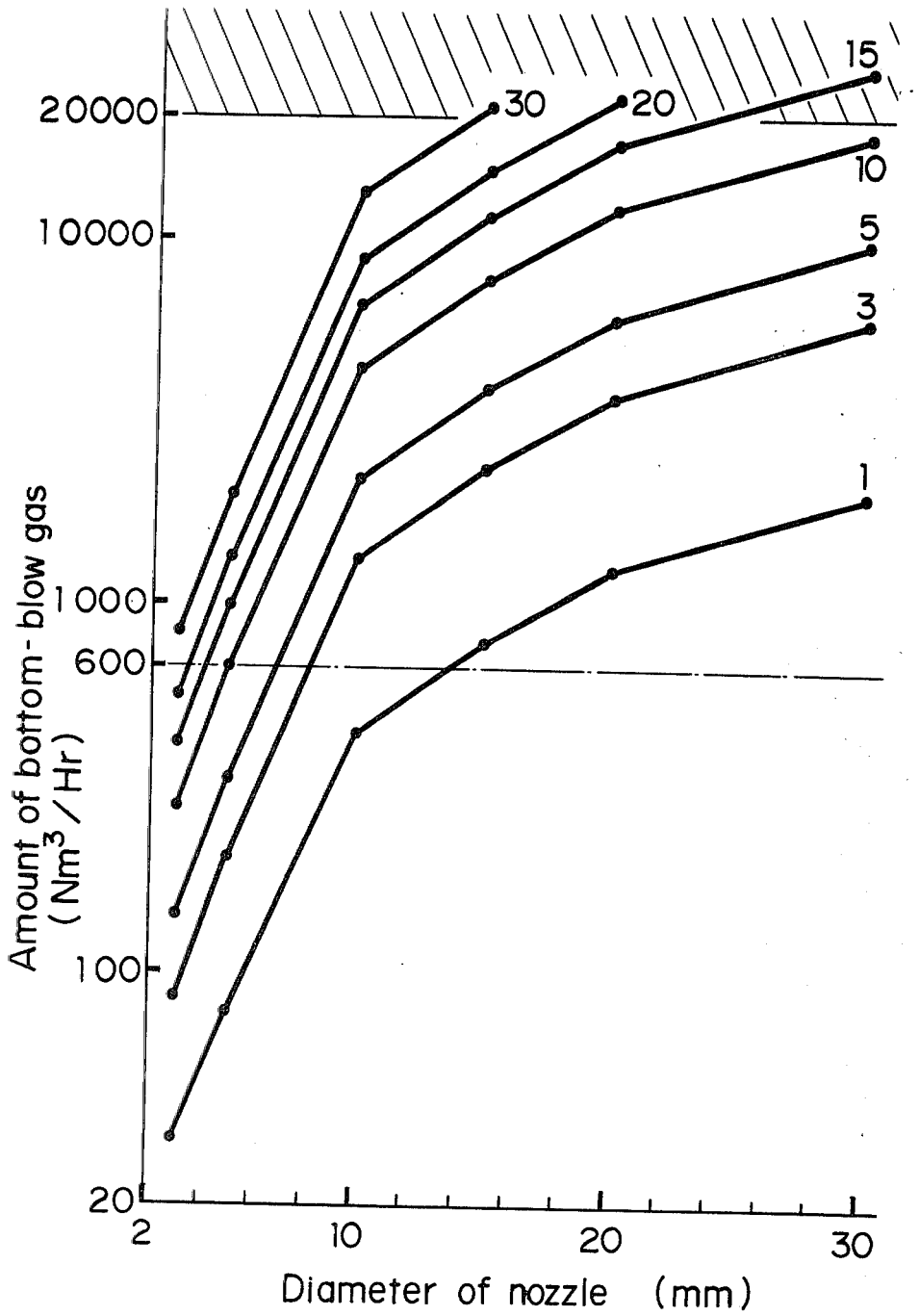
FIG. 3 is a graph showing relation between the diameter of the nozzle and the amount of the bottom-blowing gas.

FIG. 2 is a graph showing the relation between the number of the tuyeres and the agitating effect. If the tuyeres are too much prepared, bubbles of the blown gas boil up over the molten surface, and the bath and the bubbles only exchange, and the bath does not circulate and the agitation is not effected. Therefore, in the invention, the upper limit for accomplishing the agitating effect of 30% is 30 tuyeres and the lower limit therefor is one tuyere. It is preferable to place the tuyeres nearly a center of the bottom of the converter, and in such a way the bath swells nearly the center and flows from the center to the periphery to increase the agitating effec. With respect to the inside diameter of the tuyere, it should be determined in dependence on the amount of the bottom-blown gas and the number of the tuyeres used. As shown in FIG. 3, if it is less than 2 mm, the required amount of the gas is not obtained, and if it exceeds 30 mm, such amount gas is obtained where the agitation reaches the saturation. Therefore, the lower limit is 2 mm and the upper limit is 30 mm.

Figure 4:
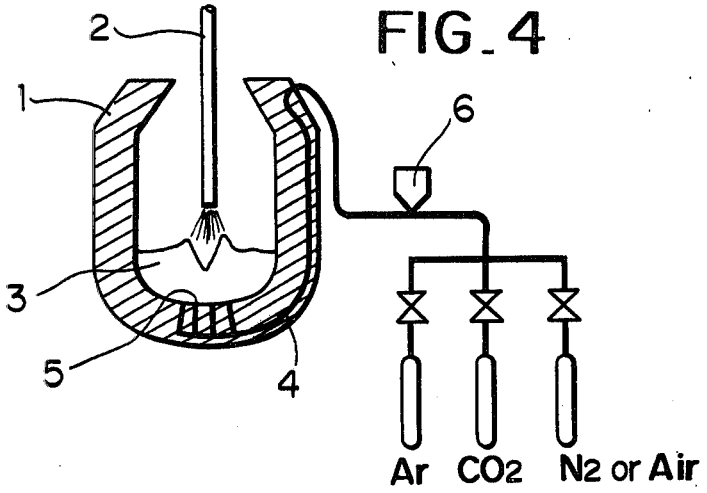
FIG. 4 is an explanatory view showing one embodiment of this invention.

FIG. 4 is an explanatory view of an example to which the inventive process is actually applied, in which the numeral 1 denotes the converter, 2 is a lance, 3 shows the molten steel, and 4 is a pipe provided in superimposed brick layer within the converter, one end of which is elongated outside from the vicinity of a mouth of the converter and the other end of which is branched to the tuyeres 5. The tuyere 5 does not need to be a double structure, but it is of a single structure. The pipe 4 may be arranged between an iron shell and the brick of the converter 1, or may be taken out externally through a hole to be formed in the iron shell at the bottom of the converter, instead of elongating from the vicinity of the converter mouth. The pipe 4 communicates with sources of $CO_2$, Ar, $N_2$ or the air. The numeral 6 shows a holder of deoxidizing agent.

A reference will be made to the actual operation. When supplying scraps, the air or $N_2$ gas of 2 to 10 $Kg/cm^2$ is blown from the tuyeres. When pouring the molten metal, $N_2$ or $CO_2$ is blown from the bottom for avoiding air pollution. After completing supply of the scraps and the molten metal, the converter 1 is erected and the pure oxygen is jetted from the top-blowing lance 2 as it is lowered, and the burnt lime is thrown into the converter. The solvent and the fluorite are added before and after throwing of the burnt lime. The lowered lance 2 is maintained at determined height above the molten surface and starts the blowing, and at the same time the bottom-blowing is changed to $CO_2$ for avoiding the bath pollution owing to $N_2$. By this bottom-blowing $CO_2$ gas the agitation of the bath is accelerated. Especially, the agitating effect is remarkable in the de-phosphorization and the de-carburization from beginning of the blowing to the middle and at the peak. In a case of such a system recovering the de-carburization generating gas, the blowing of $CO_2$ between the middle of the blowing and the end dilutes CO generating gas, and therefore the bottom-blowing is changed to Ar gas. When it is confirmed by an appropriate means that the component of the molten bath becomes desired, the converter 1 is tilted to the horizontal level to carrying out sampling (measuring the temperature, T.P sampling). If the tuyeres 5 are provided at the center of the bottom of the converter, the blowing pressure is, while sampling, decreased, or may be stopped since the nozzle at the bottom is exposed. On the other hand, if the tuyeres are provided over the bottom, the bottom-blowing gas prevails, when tilting the converter, toward the exposed, non loaded part, and so it is preferable to section the bottom of the converter.

After sampling, the converter is again erected for preparation of pouring the steel. At pouring, the tilting angle is changed in response to the pouring amount at stage between the pouring start and the pouring completion, and then if the tuyere is exposed from the steel bath, the bottom-blowing gas may be stopped.

After completion of pouring the steel, the bottom-blowing gas is changed to air or $CO_2$. The air removes advantageously clogging of the tuyere. During exhausting the slag, the air or $CO_2$ is blown, and after this exhaustion, a next preparation is to supply main raw materials. In this waiting time, the air or $N_2$ is blown from the converter bottom to avoid clogging for preparation of supplying scraps. Thus, one cycle ends, and hereafter the above operations are repeated.

With respect to high carbon steel, special steel and the like, it is possible to use particles of $CaF_2$, C and others in mixture of the blown gas from the tuyeres 5. After completion of blowing, alloy iron is appropriately blown from a hopper at the top of the converter to fully agitate the bath by the bottom-blowing gas for providing melting and reaction of the alloy iron in the converter and keeping the temperatures of the steel bath constant. It is possible to carry out the sampling and measure the temperature after making uniform the contents in the converter. The particle to be blown are not limited to soda ash only, but it is possible to add soda of alkali group and alkali earths or metals of potassium and lithium, and other compound substances.

Figure 5:
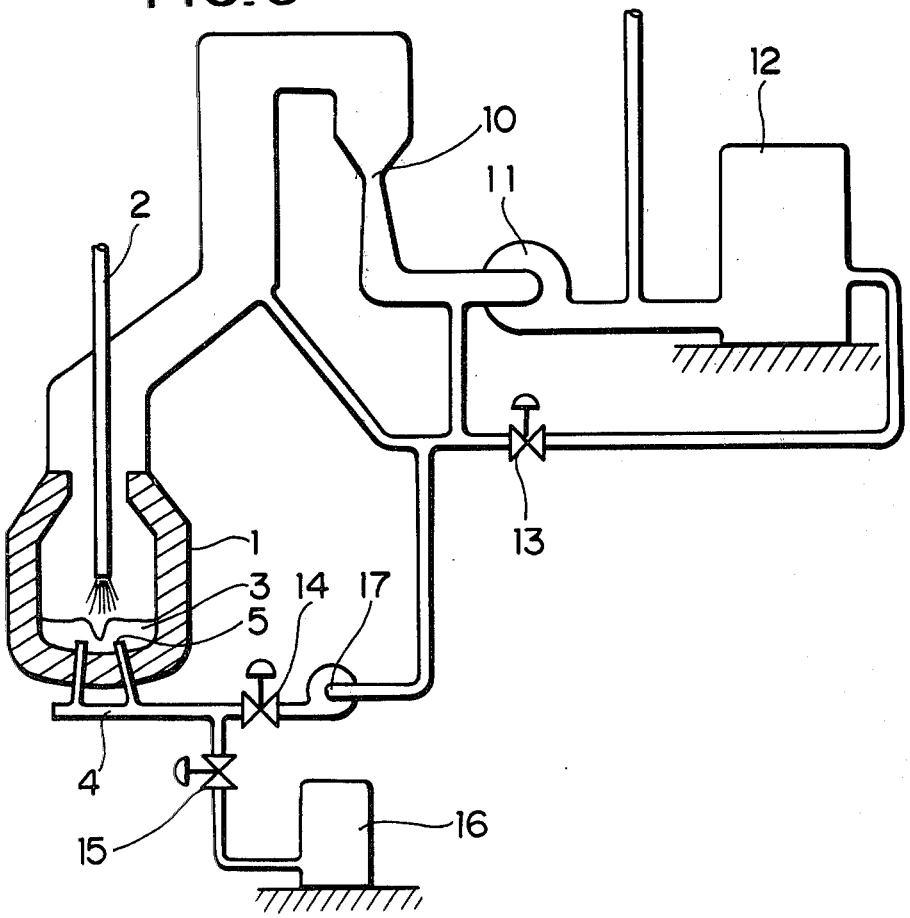
FIG. 5 is an explanatory view showing an embodiment of circulating in use LD gas as the agitating gas.

FIG. 5 shows an example circulating in use LD gas as the agitating gas. LD gas from the converter 1 is fed to a venturi 10, and LD gas is removed from dusts and cooled there, and it is sent to a tank 12 through a blower 11 and is stored there. LD gas within the tank 12 is timely fed to the tuyeres 5 by the blower 17 for agitation and it is again circulated from the top of the converter 1. Thus, LD gas is very ecomonical. In FIG. 5 the numeral 13 is an open-close valve, 14 and 15 designate valves of controlling the flowing pressure, and 16 is a tank for other inert gases.

As the agitating gas, a non oxidizing gas is preferable as mentioned above, and in general the inert gas such as Ar or $N_2$, or $CO_2$ are employed. However, these gases are high in production cost, since a generating apparatus is expensive, and further it takes transporting cost for these gases to be carried from the producing field by the truck or via the pipe, and its amount is restricted. In these circumstances, the present invention recommends usage of LD gas as the agitating gas. LD gas generated within the converter can be used in circulation, and by using LD gas as the agitating gas, it is possible to keep the cost down and heighten the efficiency.

One example of the component of LD gas used in the invention showed 74.4% CO, 3.1% $CO_2$, 20.3% $N_2$, 2.0% $H_2$ and 0.2% $O_2$, and the heating was 2350 Kcal/$Nm^3$ and the circulation was 97 $Nm^3$/t.

If LD gas is used, the other inert gases are not required or may be decreased in amount. Besides, CO% of LD gas itself increases and the heating also increases.

A next reference will be made to an example according to the present invention.

EXAMPLE 15 tuyeres were provided. Each had a single structure made of stainless steel pipe having a 4.2 mm inside diameter at the bottom of the converter. At the beginning the air was blown into the converter at a pressure of 4 Kg/$cm^3$ while the scraps of 10% of the total supply were supplied. After supplying the scrap, the blowing gas was changed to $CO_2$. The pressure of blowing $CO_2$ was 4 Kg/$cm^3$ and at this stage the hot metal of 90% of the total supply was supplied into the converter. This hot metal was at the temperature of 1350° C., and the composition thereof was as shown in the table. After supplying the hot metal, pure oxygen of 14 Kg/$cm^2$ pressure was jetted through the top-blowing lance. The top-blowing oxygen was consumed at a rate of 48 $Nm^3$/t during blowing, while the botton-blowing $CO_2$ was consumed at a rate of 0.5 $Nm^3$/t. At the ending of blowing, the bottom-blowing gas was changed to Ar and blown at a pressure of 4 Kg/$cm^2$. The temperature of the hot metal at ending was 1630° C., and the composition was 0.05% C, 0.20% Mn, 0.015% P, 0.021% S, 450 ppm$O_2$, 10 ppm$N_2$, 2.0 ppm$H_2$. The table shows the comparison between the instant inventive process, Q-BOP Process and LD Process. Since Q-BOP Process blows LP gas as the cooling gas, $H_2$ content in the steel bath is as high as 4.6 ppm, while in the invention $H_2$ is as low as 2.0 ppm. Further, the good ingot is yielded 93.1% in LD Process, while in the invention it is 94.6% near to Q-BOP Process.

As mentioned above, the present invention is incorporated with the merits of the top-blowing process and the bottom-blowing process, and thus this invention has the remarkable excellence of increasing the yield and improving the quality of the steel.

| | INVENTIVE PROCESS | | | | |
|---|---|---|---|---|---|
| Diameter (mm) of tuyure | 4.20 | | | | |
| Type of tuyure | Single stainless pipe | | | | |
| Using number of tuyures | 15 | | | | |
| Operation | | | | | |
| Hot metal ratio | 90% | | | | |
| Composition (%) of hot metal | C | Si | Mn | P | S |
| | 4.50 | 0.40 | 0.50 | 0.110 | 0.030 |
| Temperature of hot metal | 1350° C. | | | | |

-continued

| INVENTIVE PROCESS | |
|---|---|
| Up-blow $O_2$ | 48Nm$^3$/t |
| Bottom-blow $O_2$ | — |
| Bottom-blow Gas | $CO_2$: 0.5Nm$^3$/t |
| Bottom-blow Ar | 0.2Nm$^3$/t |
| Bottom-blow $N_2$ | — |
| Baked lime | 50Kg/t |
| Scheelite | 1.5Kg/t |
| Mill scale and/or iron ore | 60Kg/t |
| Results | |
| Composition (%) at end point | C Mn P S O N H<br>0.05 0.20 0.015 0.021 450ppm 10ppm 2.0ppm |
| Composition (%) of slag | T.Fe: 15 CaO: 45 $SiO_2$: 13 |
| Temperature at end point | 1630° C. |
| Yield of ingot | 94.6% |
| Consumption of alloy | Al: 2.15Kg/t FeSi: 3Kg/t FeMn: 5.1Kg/t |
| Recovery of LD gas | 100.4Nm$^3$/t |

| Q-BOP PROCESS | |
|---|---|
| Diameter (mm) of tuyure | 40 to 60ϕ |
| Type of tuyure | Double steel pipe |
| Using number of tuyures | 18 |
| Operation | |
| Hot metal ratio | 90% |
| Composition (%) of hot metal | C Si Mn P S<br>4.50 0.40 0.50 0.110 0.030 |
| Temperature of hot metal | 1350° C. |
| Up-blow $O_2$ | — |
| Bottom-blow $O_2$ | 53.5Nm$^3$/t |
| Bottom-blow Gas | LPG: 4Nm$^3$/t |
| Bottom-blow Ar | 0.2Nm$^3$/t |
| Bottom-blow $N_2$ | 20Nm$^3$/t |
| Baked lime | 45Kg/t |
| Scheelite | 1.5Kg/t |
| Mill scale and/or iron ore | 44Kg/t |
| Results | |
| Composition (%) at end point | C Mn P S O N H<br>0.05 0.30 0.015 0.020 400ppm 20ppm 4.6ppm |
| Composition (%) of slag | T.Fe: 13 CaO: 48 $SiO_2$: 16 |
| Temperature at end point | 1630° C. |
| Yield of ingot | 95.1% |
| Composition of alloy | Al: 2.0Kg/t FeSi: 4.0Kg/t FeMn: 3.4Kg/t |
| Recovery of LD gas | 116Nm$^3$/t |

| LD PROCESS | |
|---|---|
| Diameter (mm) of tuyure | — |
| Type of tuyure | — |
| Using number of tuyures | — |
| Operation | |
| Hot metal ratio | 90% |
| Composition (%) of hot metal | C Si Mn P S<br>4.50 0.40 0.50 0.110 0.030 |
| Temperature of hot metal | 1350° C. |
| Up-blow $O_2$ | 50Nm$^3$/t |
| Bottom-blow $O_2$ | — |
| Bottom-blow Gas | — |
| Bottom-blow Ar | — |
| Bottom-blow $N_2$ | — |
| Baked lime | 58.5Kg/t |
| Scheelite | 2.0Kg/t |
| Mill scale and/or iron ore | 60Kg/t |
| Results | |
| Composition (%) at end point | C Mn P S O N H<br>0.05 0.13 0.020 0.022 500ppm 13ppm 2.6ppm |
| Composition (%) of slag | T.Fe: 20 CaO: 43 $SiO_2$: 12 |
| Temperature at end point | 1630° C. |
| Yield of ingot | 93.1% |
| Consumption of alloy | Al: 2.3Kg/t FeSi: 3Kg/t FeMn: 6.3Kg/t |
| Recovery of LD gas | 96Nm$^3$/t |

We claim:

1. A steel making process comprising blowing oxygen onto the surface of molten steel held in a converter and blowing agitating gases of $\frac{1}{3}$ to 1/3000 of the amount of said oxygen thereinto through from 1 to 30 tuyeres provided at a bottom of the converter, each of said tuyeres having an inside diameter of from 2 to 300 mmϕ.

2. A process as claimed in claim 1, wherein the agitating gas is LD gas.

3. A process as claimed in claim 1, wherein air or $N_2$ is blown at a pressure of from 2 to 10 $Kg/cm^2$ from the tuyeres during a step of supplying scraps.

4. A process as claimed in claim 1, wherein $N_2$ or $CO_2$ is blown from the bottom of the converter during a step of supplying hot metal.

5. A process as claimed in claim 1, wherein after supplying scraps and hot metal into the converter, pure oxygen is jetted onto the surface of the molten metal, while burnt lime is thrown into the converter as well as solvent and fluorite are added thereto.

6. A process as claimed in claim 1, wherein the bottom-blowing gas is changed to $CO_2$ at the same time as blowing by a lance.

7. A process as claimed in claim 1, wherein the bottom-blowing gas is changed to Ar between middle and end period of blowing of oxygen.

8. A process as claimed in claim 1, wherein the bottom-blowing gas is air or $CO_2$ after pouring the molten steel.

9. A process as claimed in claim 1, further comprising blowing particles into the converter with the agitating gas, wherein the particles to be blown in mixture with the blow gas are selected from the group consisting of soda ash, soda of alkali, alkali earths or metals of potassium and lithium and mixtures thereof.

10. A process as claimed in claim 1 or claim 9, further comprising blowing treating particles into the converter with the agitating gas, wherein the treating particles to be blown in mixture with the blown gas are selected from the group consisting of $CaF_2$, $Na_2CO_3$ C or mixtures thereof.

* * * * *